US005565961A

United States Patent [19]

Shoji et al.

[11] Patent Number: 5,565,961

[45] Date of Patent: Oct. 15, 1996

[54] PROCESS CARTRIDGE AND IMAGE FORMING APPARATUS ADAPTED FOR THE MOUNTING OF THE SAME THERETO WITH AN ELASTIC MEMBER DISPOSED THEREBETWEEN

[75] Inventors: Takeo Shoji, Yokohama; Yasushi Shimizu, Tokyo, both of Japan

[73] Assignee: Canon Kabushiki Kaisha, Tokyo, Japan

[21] Appl. No.: 163,707

[22] Filed: Dec. 9, 1993

[30] Foreign Application Priority Data

Dec. 14, 1992 [JP] Japan ..... 4-352906
Oct. 8, 1993 [JP] Japan ..... 5-253056

[51] Int. Cl.[6] ..... G03G 15/00

[52] U.S. Cl. ..... 355/200; 355/210

[58] Field of Search ..... 355/200, 210, 355/211, 212, 215

[56] References Cited

U.S. PATENT DOCUMENTS

| | | | |
|---|---|---|---|
| 4,335,950 | 6/1982 | Gunzelmann et al. | 355/200 |
| 4,462,677 | 7/1984 | Onoda | 355/210 |
| 4,588,280 | 5/1986 | Ogawa et al. | 355/200 |
| 4,609,276 | 9/1986 | Mitzutani | 355/210 |
| 4,941,015 | 7/1990 | Komai et al. | 355/200 |
| 4,969,010 | 11/1990 | Tamura et al. | 355/200 X |
| 5,005,053 | 4/1991 | Kozuka | 355/200 X |
| 5,061,959 | 10/1991 | Kinoshita et al. | 355/210 |
| 5,083,158 | 1/1992 | Kashima et al. | 355/200 |
| 5,086,316 | 2/1992 | Aoki | 355/200 |
| 5,095,335 | 3/1992 | Watanabe et al. | 355/210 |
| 5,113,220 | 5/1992 | Kwak | 355/200 |
| 5,119,134 | 6/1992 | Haneda et al. | 355/212 |
| 5,231,453 | 7/1993 | Nakai et al. | 355/210 |
| 5,345,257 | 9/1994 | Deguchi et al. | 355/200 X |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

An image forming apparatus for forming images on recording media is adaptable to receiving a process cartridge detachably mounted thereto. The process cartridge has a frame, an image bearing member and a process unit which acts on the image bearing member. The image forming apparatus includes a mounting unit on which the process cartridge is mounted, and an elastic pressing member for elastically pressing against the frame of the process cartridge mounted on the mounting unit. The elastic pressing member may be mounted on the process cartridge.

24 Claims, 12 Drawing Sheets

PROCESS CARTRIDGE AND IMAGE FORMING APPARATUS ADAPTED FOR THE MOUNTING OF THE SAME THERETO WITH AN ELASTIC MEMBER DISPOSED THEREBETWEEN

BACKGROUND OF THE INVENTION

1. Field of the Invention

The present invention relates to a process cartridge, and an image forming apparatus which is capable of receiving the process cartridge mounted thereto.

The image forming apparatus may be an electrophotographic copying machine, a laser beam printer, an LED printer, or a facsimile machine.

2. Description of the Related Art

With reference to FIG. 12, a process cartridge, which can be detachably mounted to an image forming apparatus, is a unitary structure in which an image carrying member 51, a corona charger 52, a developing unit 53, a cleaning unit 54, and so on are incorporated in a single housing 55. The housing 55 has an opening 56 for an exposure operation and an opening 57 for a preexposure operation on the front and rear sides of the corona charger 52, respectively.

In recent years, a so-called contact charging method has been used to charge the photosensitive layer of the image carrying member. In this method, a voltage, which may be a d.c. voltage of 1 to 2 kilovolts or a voltage obtained by superimposing a d.c. voltage on an a.c. voltage, is applied from a power source to a conductive member, and this conductive member is brought into contact with the surface of the image bearing member so as to charge the surface of the image bearing member to a predetermined potential. Various contact charging methods, including the roller charging method, the blade charging method, the charging/cleaning method, and the brush charging method, have been proposed.

However, the conventional contact charging method in which the applied voltage contains an alternating component has a disadvantage in that a charging member, such as a roller, and the image bearing member vibrates at a frequency 2f, which is twice an alternating frequency f, or at a frequency which is an integral multiple of the frequency 2f due to the Coulomb's force, which acts between the image bearing member and the charging member, thus making the image bearing member or the like vibrate at 2f or a harmonic frequency thereof.

Also, a cleaning blade for removing toner on the image bearing member after image transfer is in contact with the image bearing member. Thus, vibrations inherent in the cleaning blade are generated between the image bearing member and the cleaning blade due to a frictional force on the contact surface between the image bearing member and the cleaning blade, vibrating the image bearing member and, generating noise having a frequency inherent to those vibrations and harmonic frequencies thereof.

Further, the vibrations of the charging member, the cleaning blade, and the image bearing member due to charging or the cleaning process cause the frame of a process cartridge to resonate, which in turn causes the frame of the image forming apparatus body to resonate and generate secondary noise.

This noise deteriorates the image quality.

SUMMARY OF THE INVENTION

An object of the present invention is to provide a process cartridge which enables the quality of images formed using the process cartridge to be further improved, and an image forming apparatus which can detachably mount such a process cartridge thereto.

Another object of the present invention is to provide a process cartridge which enables vibrations of a frame thereof and/or vibrations of a frame of an image forming apparatus, caused by vibrations of a charging member, a cleaning blade and an image bearing member, to be suppressed, and a image forming apparatus which can detachably mount such a process cartridge thereto.

Still another object of the present invention is to provide a process cartridge which enables vibrations of a frame thereof to be suppressed and which enables generation of secondary noise from a frame of an image forming apparatus body to be suppressed, and an image forming apparatus which can detachably mount such a process cartridge thereto.

A further object of the present invention is to provide an image forming apparatus for forming images on recording media, the apparatus being adapted to receive a process cartridge mounted thereto, the apparatus comprising mounting means on which the process cartridge is mounted, the process cartridge including a frame, an image bearing member, and process means which acts on the image bearing member; and an elastic pressing member for elastically pressing against the frame of the process cartridge mounted on the mounting means.

Still another object of the present invention is to provide a process cartridge mountable to an image forming apparatus body, the process cartridge comprising a frame, an image bearing member, process means which acts on the image bearing member, and a pressing member provided on an outer surface of the frame in such a manner that it contacts the image forming apparatus body when the process cartridge is mounted to the image forming apparatus.

Yet another object of the present invention is to provide an image forming apparatus for forming images on recording media, the apparatus being adapted for receiving a process cartridge detachably mounted thereto, the apparatus comprising mounting means on which the process cartridge is mounted, the process cartridge having a frame, an image bearing member, process means which acts on the image bearing member, and a pressing member provided on an outer surface of the frame in such a manner that it contacts an image forming apparatus body when the process cartridge is mounted in the image forming apparatus, and conveying means for conveying the recording media.

Still another object of the invention is to provide a process cartridge which can be mounted to an image forming apparatus body, the process cartridge comprising a frame, an image bearing member, process means which acts on the image bearing member, a protective cover provided on the frame in such a manner as to be movable between a protecting position where the cover protects the image bearing member and a retracted position where the cover retracts from the protecting position, and an elastic member provided on the protective cover.

DETAILED DESCRIPTION OF THE PREFERRED EMBODIMENTS

Figure 1:
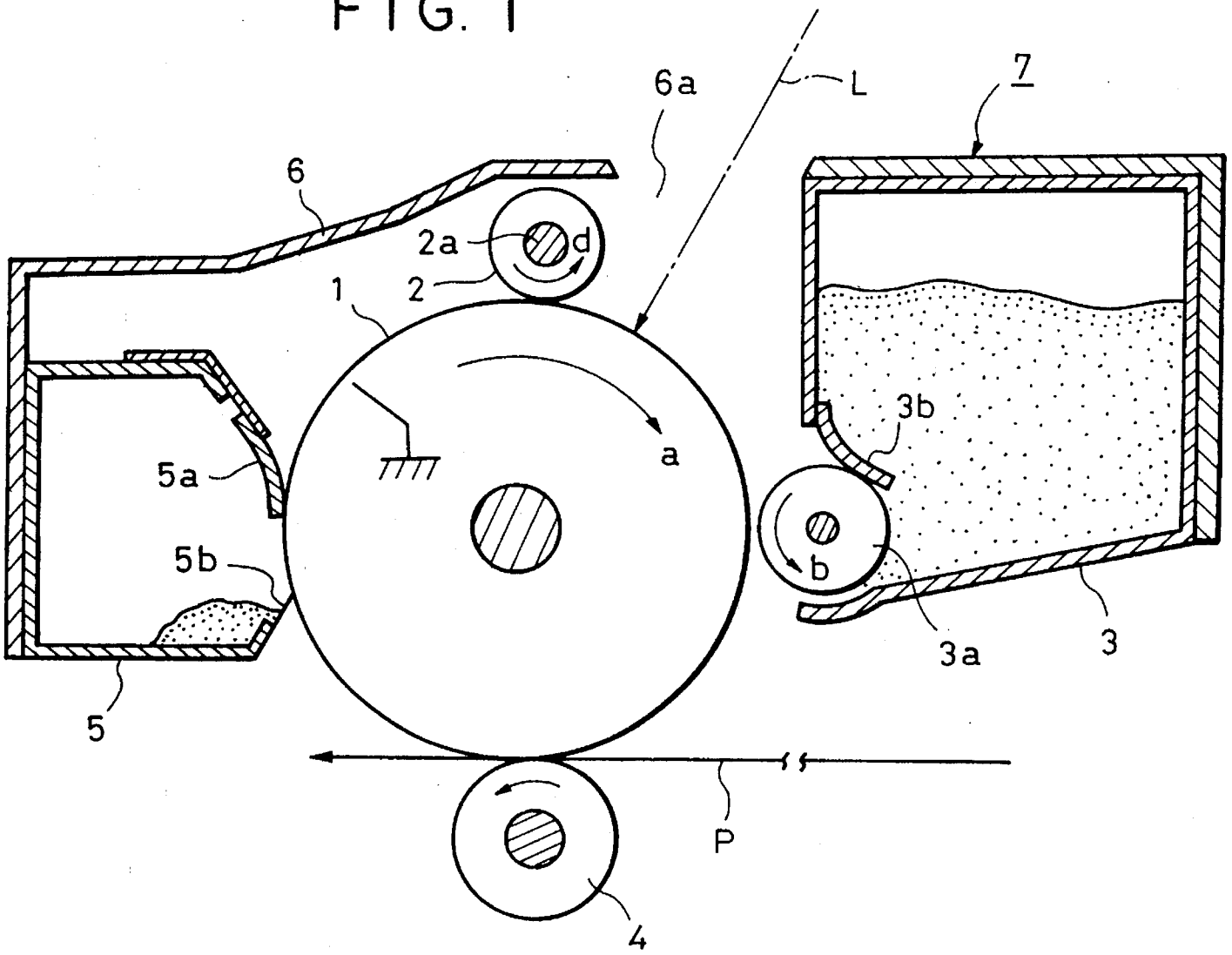
FIG. 1 is a cross-sectional view schematically illustrating a process cartridge which may be used with the present invention.

FIG. 1 is a cross-sectional view schematically illustrating a process cartridge portion of an electrophotographic image forming apparatus, such as a copying machine or a printer. This type of process cartridge employs contact charging means which makes contact with the image bearing member to charge it.

In FIG. 1, a rotary drum type electrophotographic photosensitive member 1, serving as the image bearing member, is rotatable in a direction indicated by an arrow "a" at a predetermined peripheral speed, i.e., the process speed.

A charging roller 2, serving as the contact charging means, is provided in contact with the surface of the photosensitive drum 1 for uniformly charging the surface of the photosensitive drum 1 with a predetermined polarity and to a predetermined voltage. The charging roller 2 is rotated in a direction indicated by an arrow "d" by the rotation of the photosensitive drum 1. A predetermined voltage is applied to the charging roller 2 through a conductive shaft 2*a* from a power source unit S (not shown) provided in an image forming apparatus body so as to allow the charging roller 2 to uniformly charge the surface of the photosensitive drum 1 with a predetermined polarity and to a predetermined voltage.

In this embodiment, an oscillating voltage obtained by superimposing an a.c. voltage on a d.c. voltage is applied to the charging roller 2. The oscillating voltage is a voltage having a value that varies periodically with time. More preferably, an oscillating voltage obtained by superimposing a d.c. voltage on an a.c. voltage having a peak voltage twice that of the charge initiating voltage of the photosensitive drum 1 is applied to the charging roller 2. The waveform of the oscillating voltage may be a sine wave, a rectangular wave, a triangular wave, or a pulse wave. The alternating voltage contains a voltage having a rectangular wave that is formed by periodically turning on and off a d.c. power source.

After the surface of the photosensitive drum 1 has been uniformly charged by the charging roller 2, it is exposed to an image light L corresponding to objective image data, which may be an image light formed from an original image or an image light obtained by scanning a laser beam by exposure means (not shown). This exposure forms an electrostatic latent image corresponding to the objective image data on the surface of the photosensitive drum 1. The electrostatic latent image is made visible as a toner image by a developing unit 3. In this embodiment, the developing unit 3 includes a developing sleeve 3*a* rotatable in a direction indicated by an arrow "b" to convey a toner, and a developing blade 3*b* for regulating the thickness of the toner coating on the sleeve 3*a*.

The toner image carried on the surface of the photosensitive drum 1 is sequentially transferred onto a surface of a recording medium P at a position of a transfer roller 4 provided on the image forming apparatus body. The recording medium P is fed from conveying means (not shown) between the photosensitive drum 1 and the transfer roller 4 synchronously with the rotation of the photosensitive drum 1. The recording medium P onto which the toner image has been transferred is separated from the surface of the photosensitive drum 1, and then conveyed to fixing means (not shown) provided on the image forming apparatus body.

After the transfer of the toner image onto the recording medium P, the toner remaining on the surface of the photosensitive drum 1 is removed by an elastic cleaning blade 5*a* of a cleaning unit 5 so that the photosensitive drum 1 can be used again for image formation. The removed toner is gathered by a scooping sheet 5*b*.

In the image forming apparatus of this embodiment, a process cartridge 7 having four process units, including the photosensitive drum 1, the charging roller 2, the developing unit 3, and the cleaning unit 5, are incorporated in a common housing 6 in a predetermined positional relationship. The process cartridge is detachably mounted to the image forming apparatus body as one unit. The mechanical and electrical coupling between the image forming apparatus body and the process cartridge 7 is obtained and the image forming apparatus can be made operable by mounting the process cartridge 7 to the image forming apparatus body.

The housing 6 of the process cartridge 7 has an opening 6*a* through which the image light L is illuminated.

In this embodiment, the charging roller is used as the contact charging means. However, a charging blade or brush may also be used if it generates less ozone even when used repeatedly in the charging process.

Figure 2:
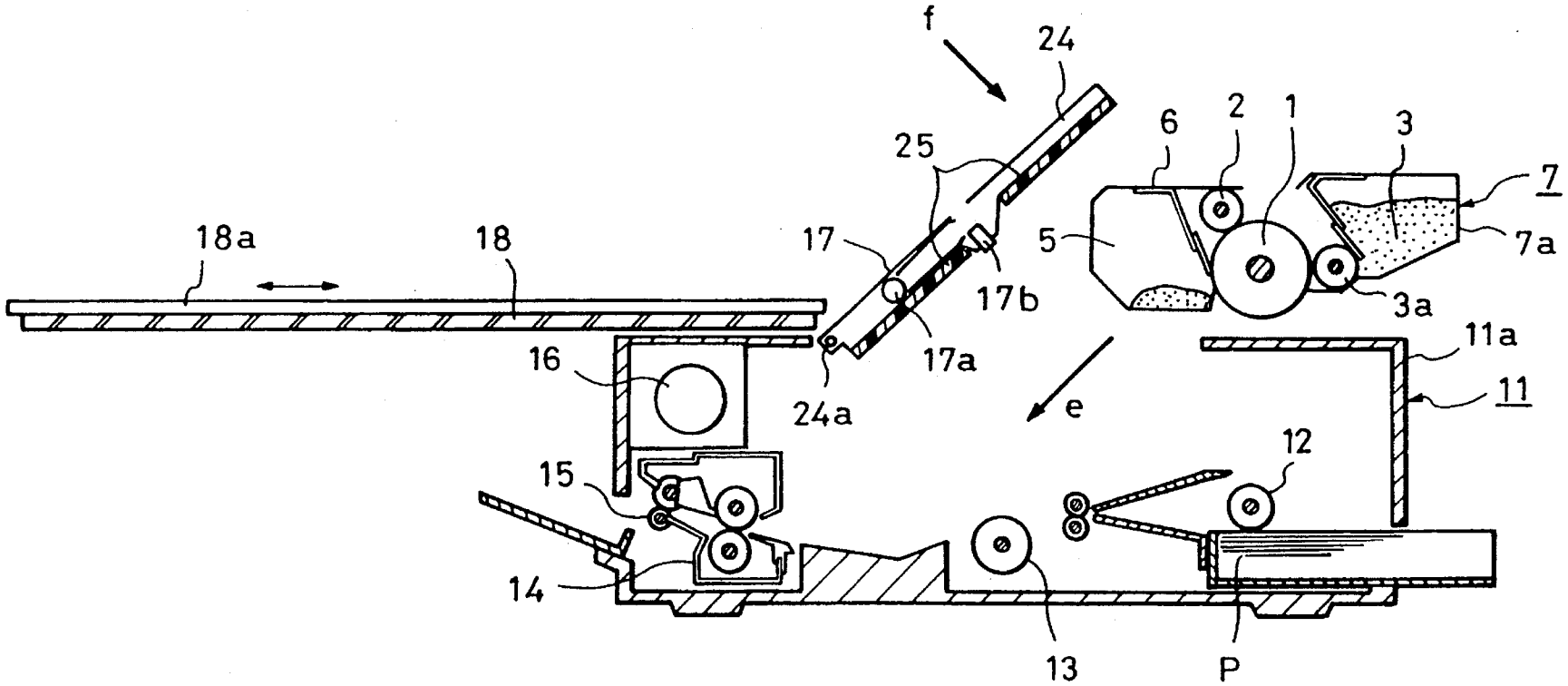
FIG. 2 illustrates mounting of the process cartridge to an image forming apparatus according to a first embodiment of the present invention.

FIG. 2 is a cross-sectional view schematically illustrating an image forming apparatus having the detachable process cartridge 7.

An image forming apparatus 11 includes a feed roller 12 serving as sheet feeding means for feeding the recording medium P to an image forming section, a transfer roller 13 serving as transfer means for transferring the toner image on the image bearing member 1 onto the recording medium P, a fixing unit 14 for fixing the toner image transferred onto the recording medium P, a discharge roller 15 serving as discharge means for discharging the fixed recording medium P to the outside of the apparatus, a fan 16, an optical reading unit 17 for reading the image data of an original, the optical reading unit 17 including an illumination lamp 17*a* and a lens 17*b*, an original base 18 which is movable in the directions indicated by a bidirectional arrow with an original set thereon, and an original pressing plate 18*a*. The above-described process cartridge 7 can be removed from and mounted to the image forming apparatus 11.

The charging roller 2 is made of a conductive member in which conductive powder, such as epichlorohydrine rubber or carbon black, is scattered appropriately so as to obtain a volume resistivity of $10^6$ Ωcm. A d.c. voltage and an a.c. voltage having a frequency f of 450 Hz are applied between the charging roller 2 and the image bearing member 1. Accordingly, a very low level of noise having a frequency 2f (=900 Hz) or an integral multiple of that frequency, 4f, 6f, . . . may be generated due to the electrostatic force which acts between the charging roller 2 and the image bearing member 1.

Figure 3:
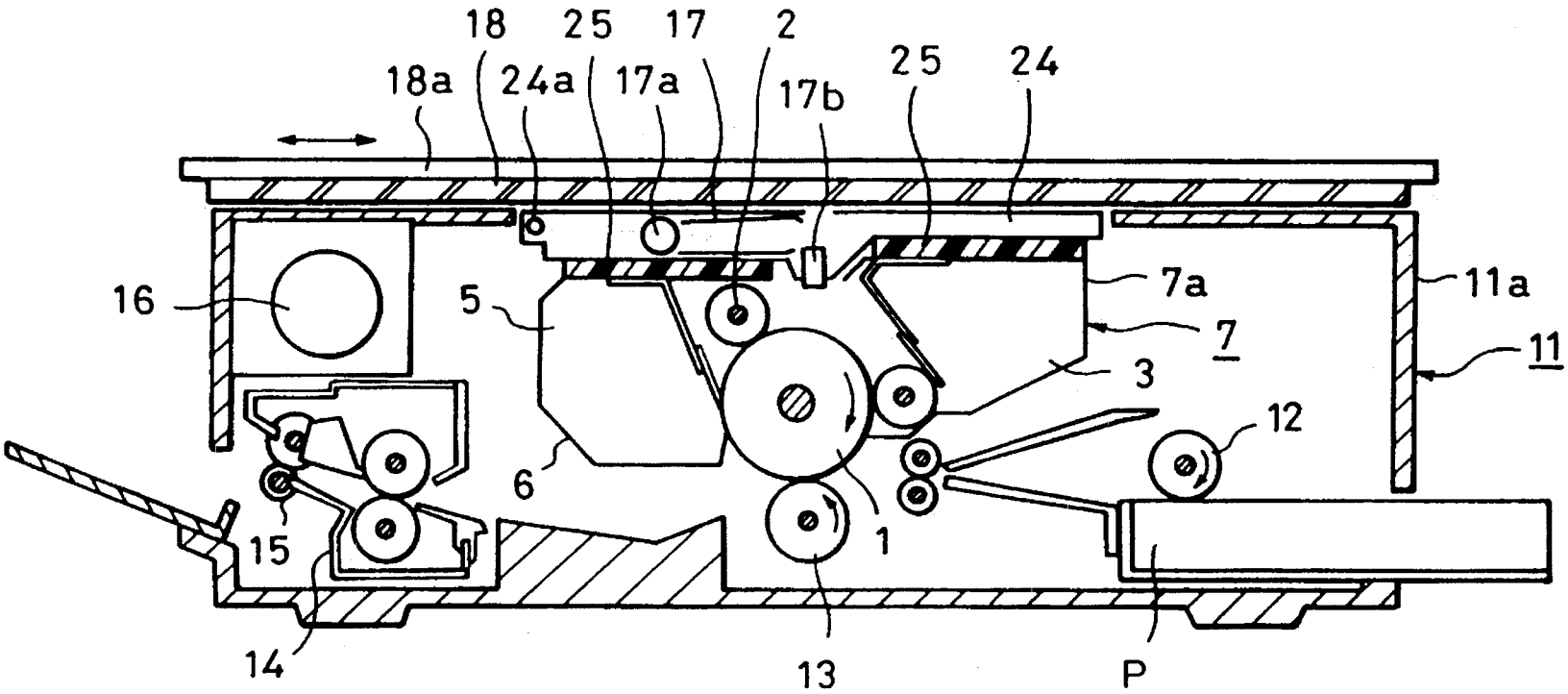
FIG. 3 illustrates the state in which the process cartridge has been mounted to the image forming apparatus according to the first embodiment of the present invention.

The process cartridge 7 is mounted to an image forming apparatus body 11 by inserting the process cartridge 7 into the apparatus body 11 in a direction indicated by an arrow "e". The process cartridge 7 is fixed in the apparatus body 11 at a predetermined position by closing an upper lid 24 provided on the apparatus body 11 in such a manner that it can close in a direction indicated by an arrow "f", whereby mounting of the process cartridge 7 is completed. This state is illustrated in FIG. 3. The upper lid 24 is pivotal about a shaft 24*a*, and supports the optical reading unit 17.

A frame 7*a* of the process cartridge 7 and a frame 11*a* of the apparatus body 11 including the upper lid 24 may be made of a polystyrene resin. The vibrations of the charging roller 2 and those of the image bearing member 1, generated by charging, vibrate the frame 7*a* of the process cartridge 7, which in turn may vibrate the entire frame 11*a* of the apparatus body 11, generating a very low level of noise.

In this embodiment, a butyl rubber sheet 25 having a thickness of 3 mm and a Shore A hardness of 70 degrees is adhered to the inner surface of the upper lid 24 as an elastic member in such a manner that it contacts the upper surface of the process cartridge 7. Hence, closing of the upper lid 24 brings the butyl rubber sheet 25 into close contact with the frame 7*a* of the process cartridge 7.

The sandwiched structure in which the rubber sheet, which is the elastic member, is interposed between the upper lid 24 and the process cartridge 7 acts as a damper which suppresses not only vibrations of the frame 7*a* of the process cartridge 7 but also transmission of the vibrations from the process cartridge 7 to the frame 11*a* of the copying machine 11. This suppresses the noise generated by the vibrations of the frames 7*a* and 11*a* of the process cartridge 7 and copying machine 11. For the above-described reasons, the use of an upper lid made of a metal plate having a large mass further increases the above-described sound-reducing effect.

In this embodiment, the elastic member 25 adhered to the upper lid 24 makes contact with the upper surface of the process cartridge 7 serving as a vibrating member. When the elastic member 25 is not in contact with the process cartridge 7, the amplitude of the vibrations of the upper surface of the process cartridge is higher at a central portion thereof than that of the vibrations at an end portion thereof. Thus, as the contact area of the elastic member 25 with the central portion of the upper surface of the process cartridge becomes wider, the more effectively the vibrations of the process cartridge can be suppressed.

Figure 11:
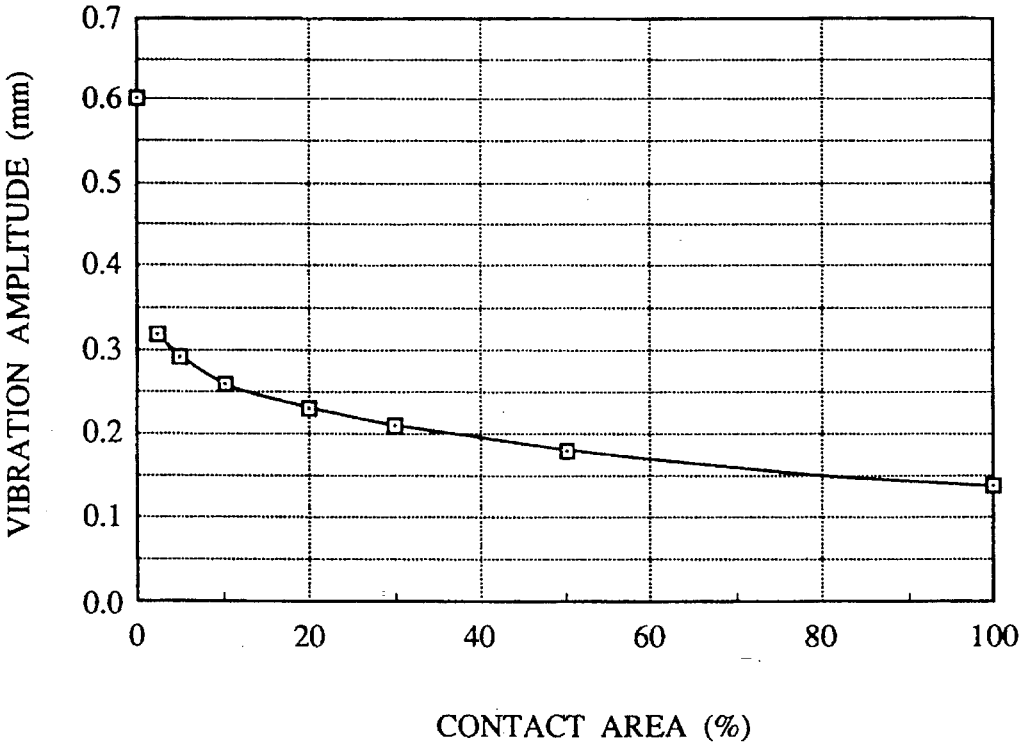
FIG. 11 is a graph showing the relationship between the contact area and the vibration amplitude in the embodiments of the present invention.
Figure 12:
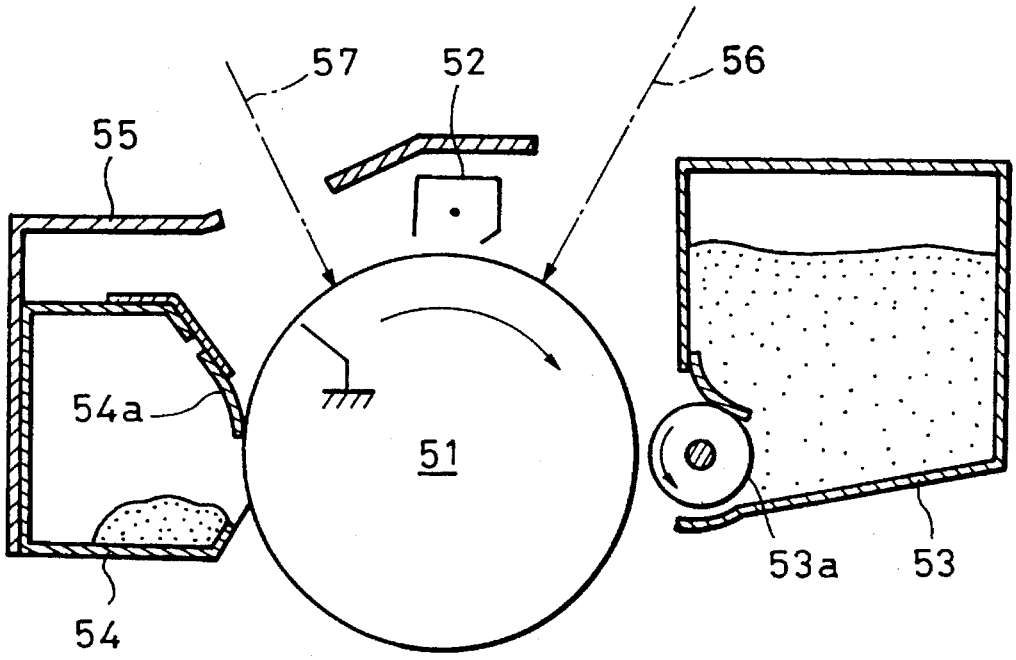
FIG. 12 PRIOR ART
FIG. 12 illustrates a conventional process cartridge.

FIG. 11 is a graph showing the relation between the proportion of the area of the butyl rubber 25 which presses against the upper surface of the process cartridge and the maximum amplitude of the vibrations observed in the upper surface portion of the process cartridge. The area of the butyl rubber 25 in the graph is a percentage per hundred indicating that the butyl rubber presses against the entire upper surface of the process cartridge 7, and the provision of the butyl rubber 25 is centered on the central portion of the upper surface of the process cartridge.

It is apparent from the graph that when the area of the rubber 25 which is in contact with the process cartridge is at least 10% of the entire area of the upper surface of the process cartridge 7, a similar effect to that when the rubber 25 presses against the entire area of the upper surface of the process cartridge 7 can be obtained, which is sufficient for prevention of vibrations.

In this embodiment, butyl rubber having a Shore A hardness of 70 degrees and a tan δ (tan δ: the loss tangent)= 0.3 is used as the elastic member 25 adhered to the upper lid 24. The effective properties of the elastic material are a Shore A hardness in the range between 30 degrees to 90 degrees and a tan δ of 0.1 or above, and preferably in the range of 0.1 to 1.0.

Examples of the material suitable for the elastic member include butyl rubber, natural rubber, SBR, chlorine type rubber, urethane rubber, silicone rubber, fluororubber, EPDM rubber, a mixture of any combination of these components, and any of the above-described materials which contains an inorganic filler and an oil to obtain the above-described properties.

In this embodiment, the rubber sheet 25 is adhered to the inner surface of the upper lid 24. However, the rubber sheet 25 may be adhered to the upper surface of the process cartridge 7 which makes contact with the upper lid 24.

In this embodiment, the vibrations of the frame 7*a* of the process cartridge 7 could be reduced from $6\times10^{-1}$ μm to $1.4\times10^{-1}$ μm, and induction of secondary noise is thus suppressed.

The above-described embodiment relates to the case where the butyl rubber sheet 25, serving as the elastic member, is provided on the upper lid 24 of the image forming apparatus body 11, which makes contact with the process cartridge 7 when the process cartridge is mounted in the image forming apparatus body. Other embodiments will now be described with reference to FIGS. 4 through 10. Since the general configuration of these embodiments is substantially the same as that of the above embodiment, a detailed description thereof is omitted. Identical reference numerals in FIG. 4 through 10 to those in FIGS. 1 through 3 represent similar or identical elements.

Figure 4:
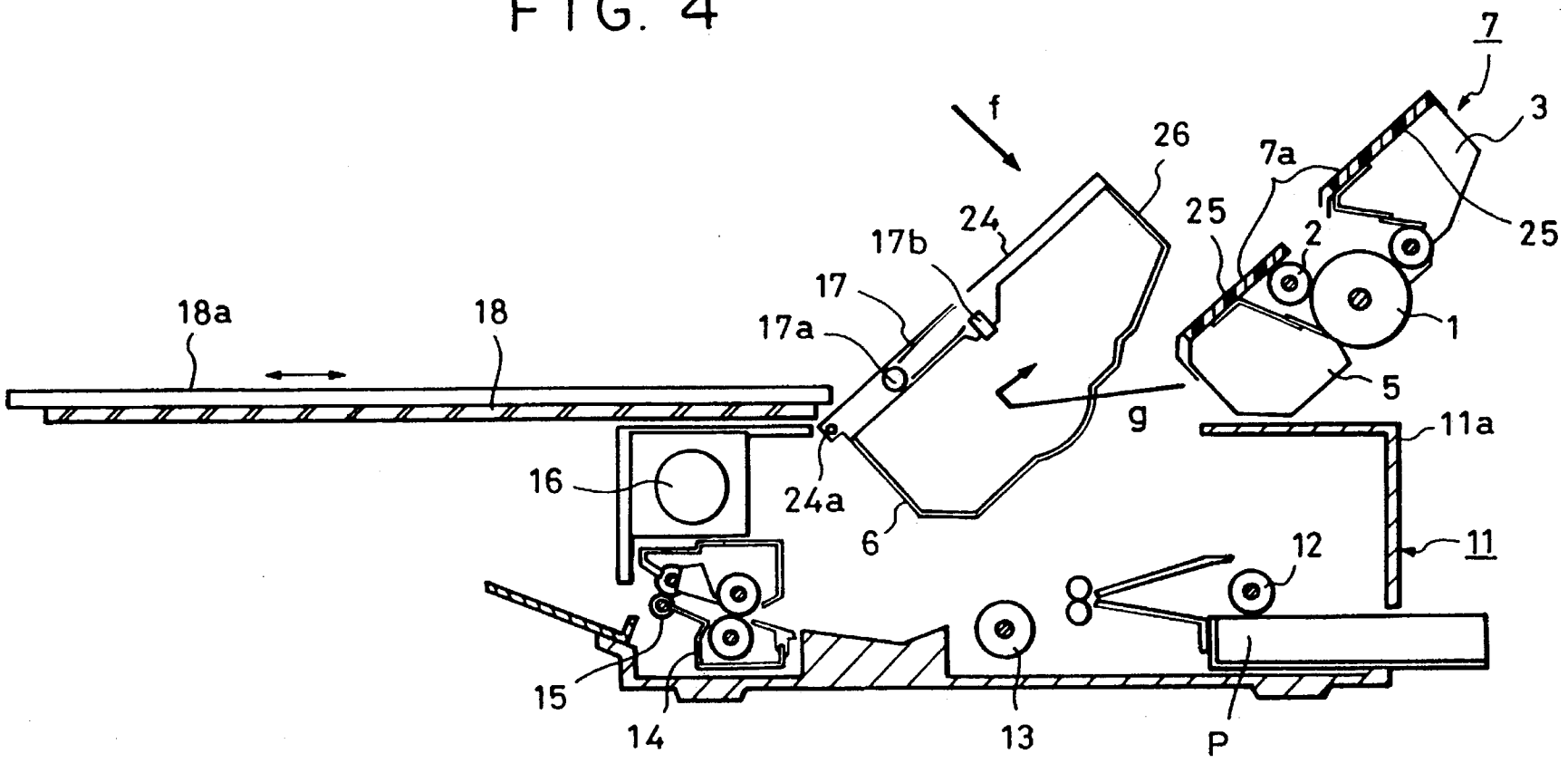
FIG. 4 illustrates mounting of the process cartridge to the image forming apparatus according to a second embodiment of the present invention.

In a second embodiment shown in FIG. 4, the process cartridge 7 is mounted to the apparatus body 11 by inserting the process cartridge 7 into a cartridge holder 26 formed integrally with the upper lid 24 of the apparatus body 11 in a direction indicated by an arrow "g". The mounting of the process cartridge 7 is completed by closing the upper lid 24 in a direction indicated by the arrow "f".

In this embodiment, the butyl rubber sheet 25, serving as the elastic member, is provided over the entire longitudinal length of the process cartridge 7 between the frame 7*a* of the process cartridge 7 and the cleaning unit 5 and between the frame 7*a* and the developing unit 3. Consequently, a damping structure can be obtained by the process cartridge 7 alone. Further, mounting of the process cartridge 7 to the apparatus body 11 makes the frame 7*a* and the upper lid 24 one unit, thus substantially increasing the weight of that portion of the apparatus body. This further improves the damping effect.

As a result, vibrations of the process cartridge 7 and transmission of those vibrations to the apparatus body 11 can be suppressed, thus suppressing amplification of the noise, as in the case of the aforementioned embodiment.

Figure 5:
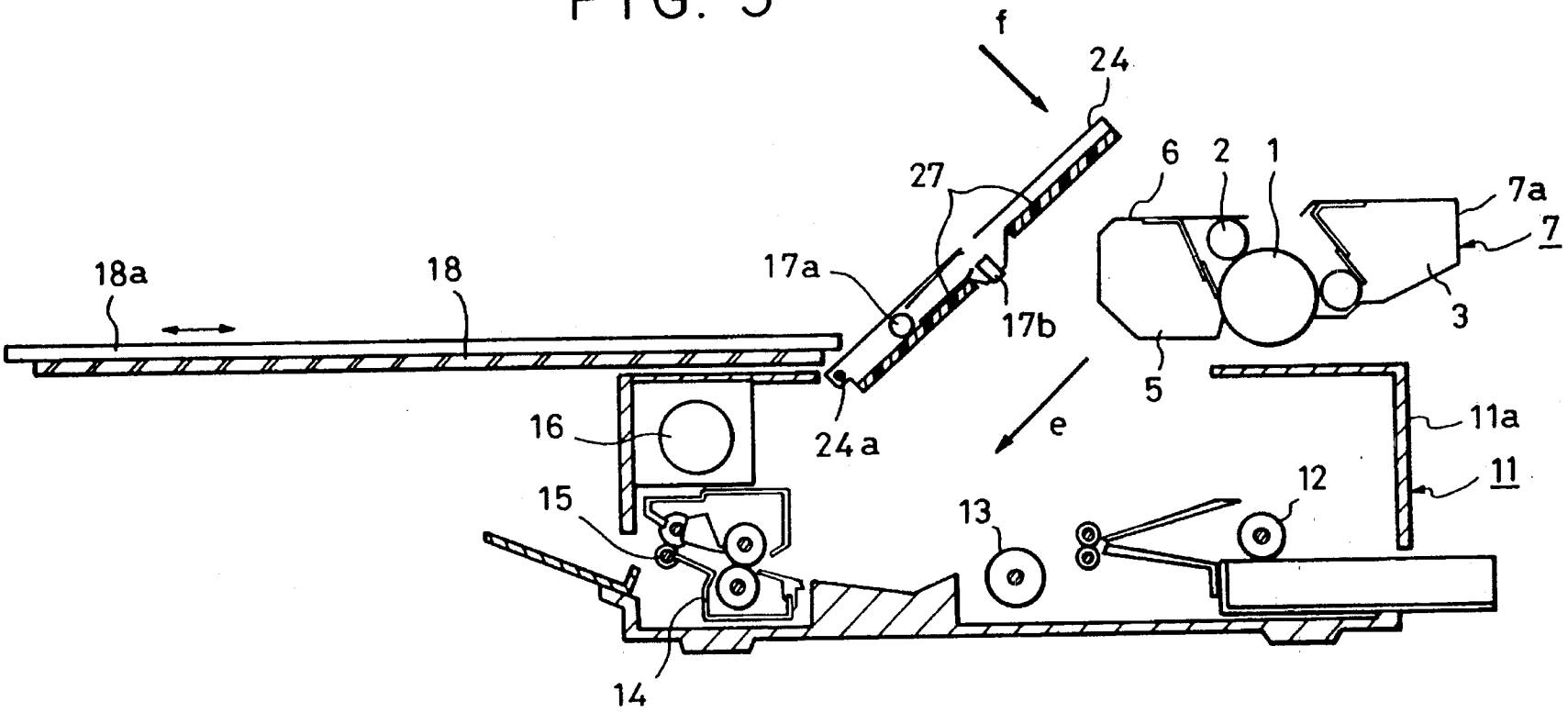
FIG. 5 illustrates mounting of the process cartridge to the image forming apparatus according to a third embodiment of the present invention.

In a third embodiment shown in FIG. 5, the process cartridge 7 is mounted to the image forming apparatus body 11 in the same manner as that of the first embodiment.

Figure 6:
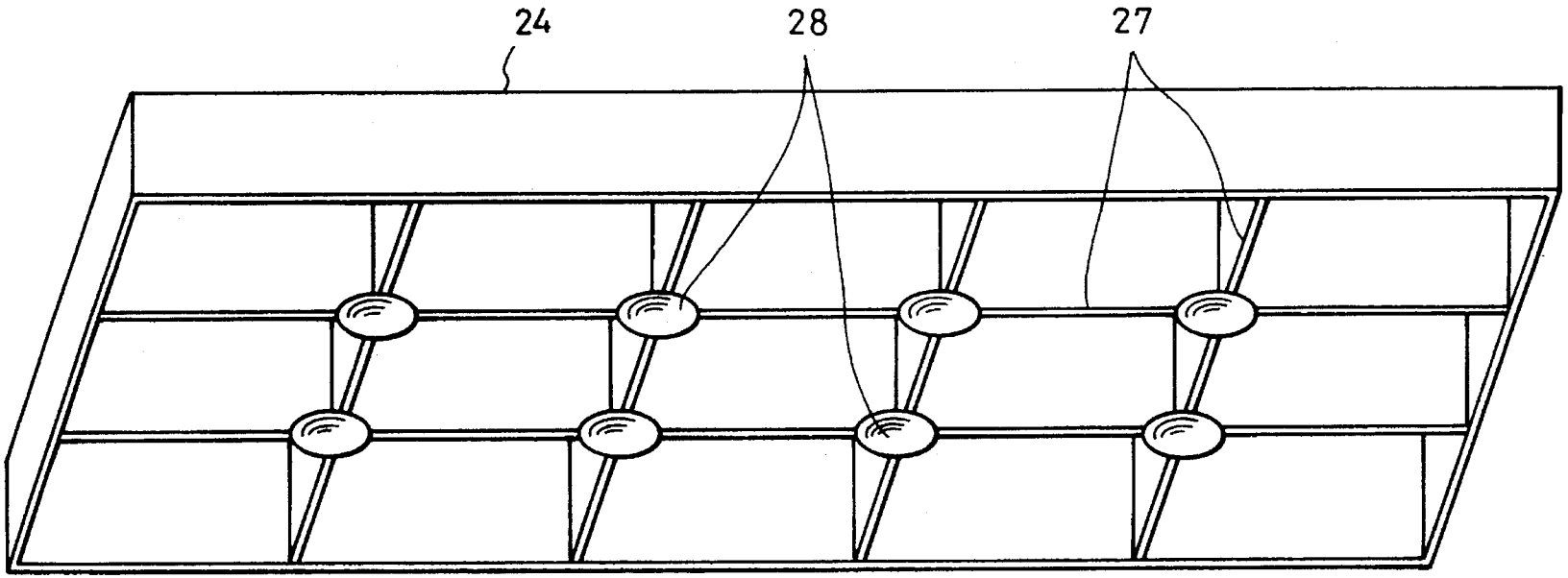
FIG. 6 illustrates an example of an elastic member according to the third embodiment of the present invention.

In this embodiment, lattice-shaped ribs 27 shown in FIG. 6 are provided on the surface of the upper lid 24 of the apparatus body 11 which makes contact with the process cartridge 7, and small spherical protrusions, two of which are denoted by reference numeral 28, are provided at the intersections of the lattice-shaped ribs 27. Consequently, closing of the upper lid 24 causes the protrusions 28 to press against the frame 7*a* of the process cartridge 7, suppressing the vibrations of the process cartridge 7. Since the upper lid 24 of the apparatus body 11 has a lattice-shaped rib structure, it does not readily vibrate. This reduces the transmission of the vibrations of the process cartridge to the upper lid. Further, there is a space between the upper lid 24 and the process cartridge 7, and this moderates an increase in the temperature in the image forming apparatus.

Figure 7:
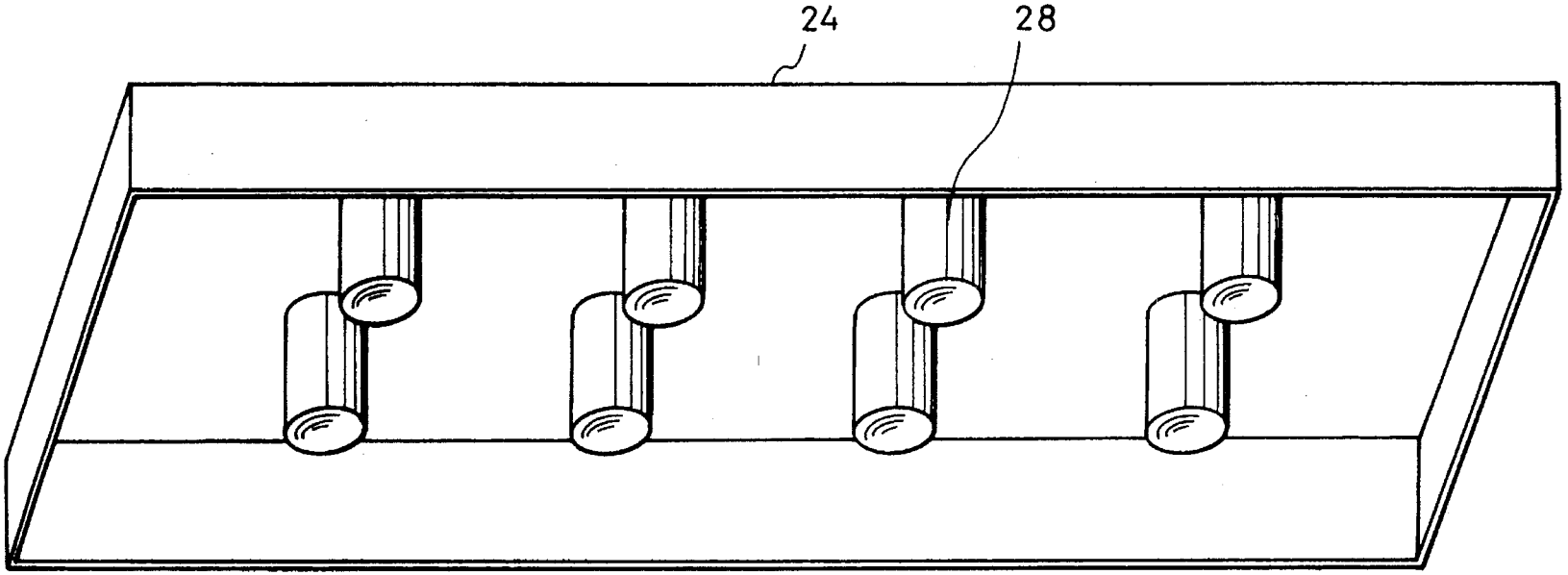
FIG. 7 illustrates another example of the elastic member according to the third embodiment of the present invention.

As shown in FIG. 7, it may also be arranged such that only the protrusions, one of which is denoted by reference numeral 28, serving as the elastic member, press against the frame 7*a* of the process cartridge 7.

In this embodiment, the greater the number of protrusions 28, the better. However, the distribution of the protrusions 28 must be centered on the central portion of the surface of the upper lid 24 which makes contact with the process cartridge 7.

In this way, vibrations of the process cartridge 7 and transmission of those vibrations to the apparatus body 11 can be suppressed, thus suppressing amplification of noise, as in the case of the aforementioned embodiments.

The material forming the protrusions 28 is the same as that of the elastic member.

Figure 8:
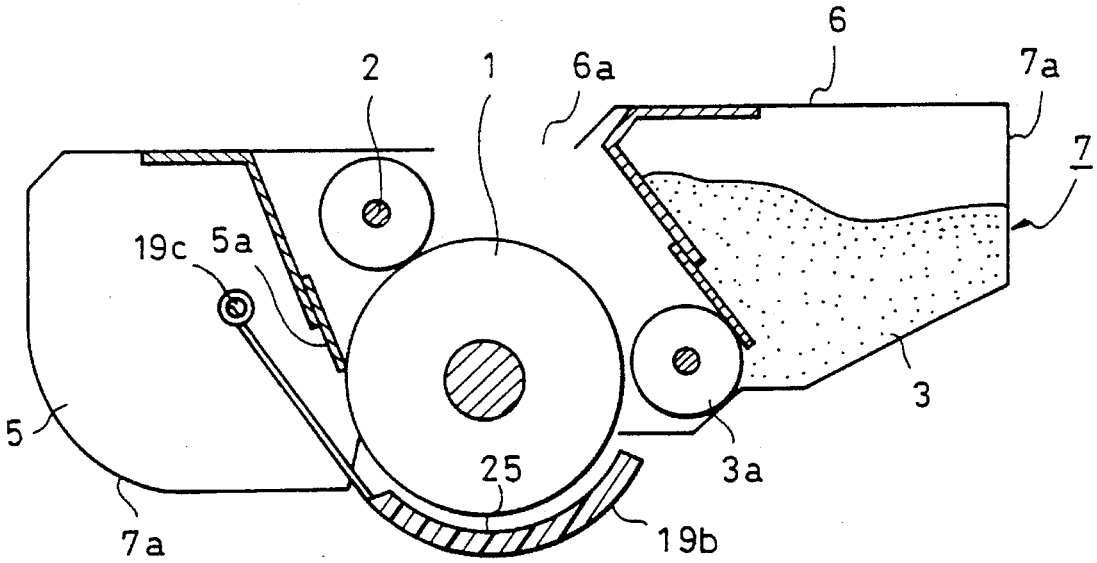
FIG. 8 illustrates a process cartridge according to a fourth embodiment of the present invention.
Figure 9:
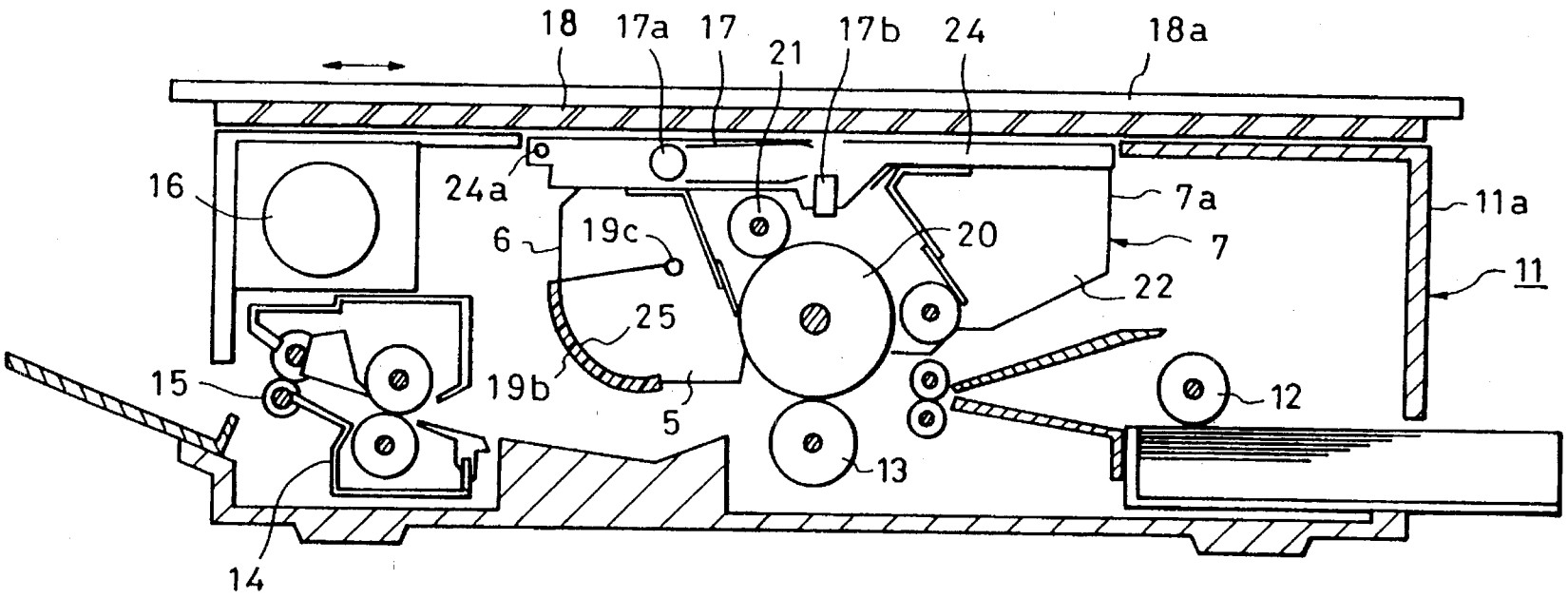
FIG. 9 illustrates the state in which the process cartridge according to the fourth embodiment of the present invention has been mounted to the image forming apparatus.

In a fourth embodiment shown in FIG. 8, the process cartridge 7 has a protective shutter 19*b* for protecting the image bearing member 1. When the process cartridge 7 is mounted to the apparatus body 11, the shutter 19*b* moves toward the cleaning unit 5, as shown in FIG. 9. The shutter 19*b* is pivotal about a shaft 19*c*, and is movable between a protecting position where the shutter 19*b* protects the image bearing member 1 and a retracted position. The butyl rubber sheet 25, serving as the elastic member, is adhered on the inner surface of the shutter 19*b* in the longitudinal direction of the process cartridge 7. When the shutter 19*b* is opened, the butyl rubber sheet 25 makes close contact with an outer surface, i.e., the frame 7*a*, of the cleaning unit 5 of the process cartridge 7, suppressing vibrations of the cleaning unit 5. The shutter 19*b* is normally urged in a direction in which it is closed by a spring (not shown), and is opened by an opening/closing mechanism (not shown) provided in the apparatus body 11 synchronously with the mounting operation of the process cartridge 7 to the apparatus body 11.

In this embodiment, the area of the elastic member 25 on the shutter 19*b* which presses against the cleaning unit 5 is 10% or above of the surface area of the cleaning unit 5, and the provision of the elastic member is centered on the center of the outer surface of the cleaning unit 5.

Further, the properties of the elastic member are a Shore A hardness in the range of 30 degrees to 90 degrees and a tan $\delta$ of 0.1 or above and preferably in the range of 0.1 to 1.0.

Examples of the material of the elastic member include butyl rubber, natural rubber, SBR (styrene butadiene copolymer), chlorine type rubber, urethane rubber, silicone rubber, fluororubber, EPDM (tercopolymer of ethylene propylene diene) rubber, a mixture of any combination of these components, and any of the above-described materials which contains an inorganic filler and an oil to assure the above-described properties.

Figure 10:
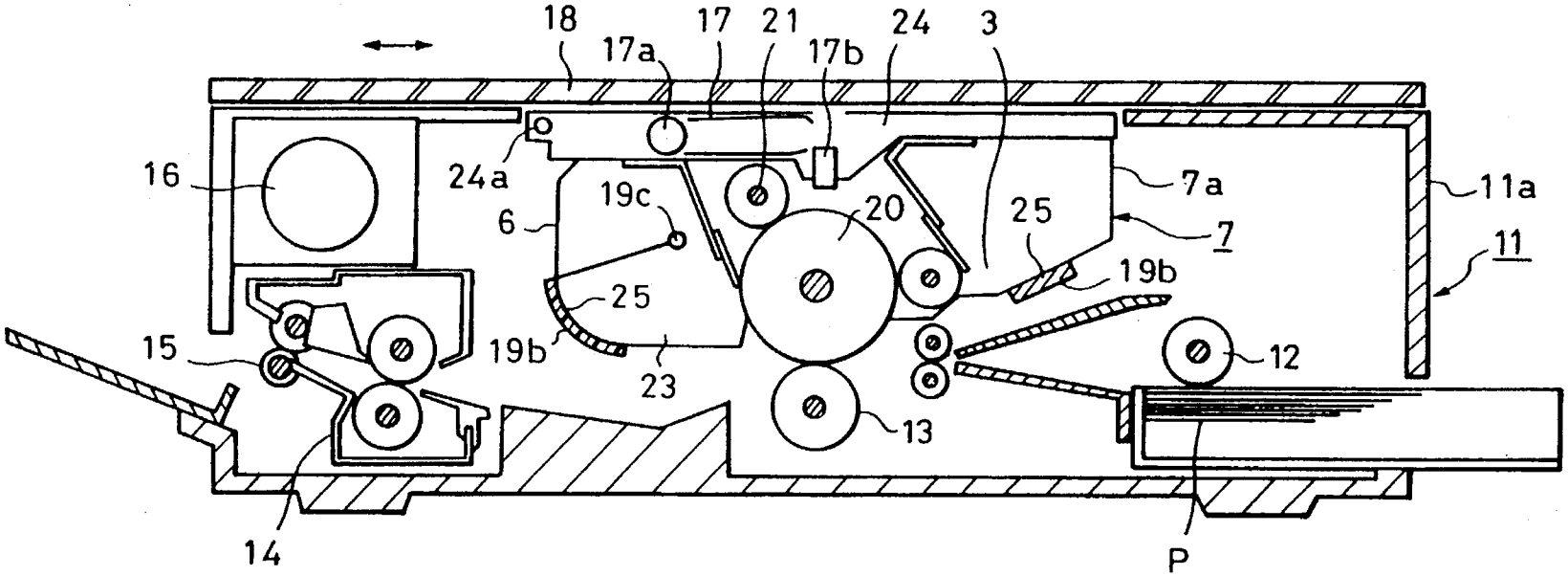
FIG. 10 illustrates the process cartridge according to the fourth embodiment of the present invention in which shutters are opened in opposite directions.

In this embodiment, the shutter is moved toward the cleaning unit 5. However, where the developing unit 3 is vibrated vigorously, the shutter may be moved toward the developing unit 3. Further, as shown in FIG. 10, the shutter may be divided into two parts which can be moved in opposite directions. (The illustration of a shaft of the shutter 19*b* which opens toward the developing unit 3 is omitted.)

In the above-described embodiments, the elastic member is provided on either the image forming apparatus or the process cartridge on the contact surface therebetween. Accordingly, when the process cartridge is mounted to the image forming apparatus, the contact surface between the process cartridge and the image forming apparatus forms the damping structure, and consequently, vibrations of the frame of the process cartridge and image forming apparatus can be suppressed, thus suppressing generation of noise.

The above-described process cartridge may be a cartridge in which the charging means, the developing means or the cleaning unit, and the electrophotographic photosensitive member are formed as one unit which is detachably mounted in the image forming apparatus body. Alternatively, the process cartridge may be a cartridge in which the electrophotographic photosensitive member and at least one component selected from the group consisting of the charging means, the developing means and the cleaning means are formed as one unit which can be detachably mounted to the image forming apparatus body. Alternatively, the process cartridge may be a cartridge in which at least the electrophotographic photosensitive member and the developing means are formed as one unit which can be detachably mounted to the image forming apparatus body.

As will be understood from the foregoing description, it is possible according to the present invention to provide a process cartridge and an image forming apparatus which can suppress not only vibrations of the frame of the process cartridge but also vibrations of the frame of the image forming apparatus body.

A further object of the present invention is to provide an image forming apparatus for forming images on recording media, the apparatus being adapted to receive a process cartridge mounted thereto, the apparatus comprising mounting means on which the process cartridge is mounted, the process cartridge including a frame, an image bearing member, and process means which acts on the image bearing member; and an elastic pressing member for elastically pressing against the frame of the process cartridge mounted on the mounting means.

Still another object of the present invention is to provide a process cartridge mountable to an image forming apparatus body, the process cartridge comprising a frame, an image bearing member, process means which acts on the image bearing member, and a pressing member provided on an outer surface of the frame in such a manner that it contacts the image forming apparatus body when the process cartridge is mounted to the image forming apparatus.

Yet another object of the present invention is to provide an image forming apparatus for forming images on recording media, the apparatus being adapted for receiving a process cartridge detachably mounted thereto, the apparatus comprising mounting means on which the process cartridge is mounted, the process cartridge having a frame, an image bearing member, process means which acts on the image bearing member, and a pressing member provided on an outer surface of the frame in such a manner that it contacts an image forming apparatus body when the process cartridge is mounted in the image forming apparatus, and conveying means for conveying the recording media.

Still another object of the invention is to provide a process cartridge which can be mounted to an image forming apparatus body, the process cartridge comprising a frame, an image bearing member, process means which acts on the image bearing member, a protective cover provided on the frame in such a manner as to be movable between a protecting position where the cover protects the image bearing member and a retracted position where the cover retracts from the protecting position, and an elastic member provided on the protective cover.

While the present invention has been described with respect to what is presently considered to be the preferred embodiments, it is to be understood that the invention is not limited to the disclosed embodiments. To the contrary, the invention is tended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus for forming images on recording media, said apparatus being adapted to receive a process cartridge detachably mounted thereto, said apparatus comprising:

mounting means on which said process cartridge is detachably mounted, said process cartridge having a frame, an electrophotographic photosensitive member and process means which acts on the electrophotographic photosensitive member;

a lid that is openable to provide access to said mounting means; and an elastic pressing member fixed to an inside surface of said lid for suppressing vibration by elastically pressing against an upper surface of said frame of said process cartridge mounted on said mounting means when said lid is moved to a closed position.

2. The image forming apparatus according to claim 1, wherein said elastic pressing member has a Shore A hardness of between approximately 30 degrees and 90 degrees.

3. The image forming apparatus according to claim 1, wherein said elastic pressing member has a loss tangent of between approximately 0.1 and 1.0.

4. The image forming apparatus according to claim 1, wherein said elastic pressing member makes contact with at least 10% of an area of an upper surface of the frame of the process cartridge.

5. The image forming apparatus according to claim 1, wherein said elastic pressing member is of a material selected from the group consisting of butyl rubber, natural rubber, SBR (styrene butadiene copolymer), chlorine type rubber, urethane rubber, silicone rubber, fluororubber, EPDM (tercopolymer of ethylene propylene diene) rubber, and any of the foregoing materials which contains an inorganic filler and an oil.

6. The image forming apparatus according to claim 1, wherein said elastic pressing member comprises an elastic rubber sheet.

7. The image forming apparatus according to claim 1, wherein said image forming apparatus is an electrophotographic copying machine.

8. The image forming apparatus according to claim 1, wherein said image forming apparatus is a laser beam printer.

9. The image forming apparatus according to claim 1, wherein said image forming apparatus is a facsimile machine.

10. A process cartridge detachably mountable to a main assembly of an image forming apparatus, said process cartridge comprising:

a frame comprising an upper surface;

an electrophotographic photosensitive member;

process means which acts on said electrophotographic photosensitive member; and an elastic pressing member for suppressing vibration and provided on said upper surface of said frame in such a manner that it is sandwiched between said image forming apparatus and said upper surface of said frame when said process cartridge is mounted to said image forming apparatus.

11. The process cartridge according to claim 10, wherein said elastic pressing member has a Shore A hardness of between approximately 30 degrees and 90 degrees.

12. The process cartridge according to claim 10, wherein said elastic pressing member has a loss tangent of between approximately 0.1 and 1.0.

13. The process cartridge according to claim 10, wherein said elastic pressing member is in contact with at least 10% or more of an area of an upper surface of said frame of said process cartridge.

14. The process cartridge according to claim 10, wherein said elastic pressing member is made of a material selected from the group consisting of butyl rubber, natural rubber, SBR (styrene butadiene copolymer), chlorine type rubber, urethane rubber, silicone rubber, flourorubber, EPDM (tercopolymer of ethylene propylene diene) rubber, and any material which contains an inorganic filler and an oil.

15. The process cartridge according to claim 10, wherein said elastic pressing member comprises an elastic rubber sheet.

16. The process cartridge according to claim 10, wherein said process cartridge comprises a cartridge in which charging means, developing means or cleaning means, serving as said process means, and an image bearing member, serving as said electrophotographic photosensitive member, are incorporated as one unit being detachably mountable to said image forming apparatus.

17. The process cartridge according to claim 10, wherein said process cartridge comprises a cartridge in which an image bearing member, serving as said electrophotographic photosensitive member, and at least one component selected from a group consisting of charging means, developing means and cleaning means, serving as said process means, are incorporated as one unit being detachably mountable to said image forming apparatus.

18. The process cartridge according to claim 10, wherein said process cartridge comprises a cartridge in which at least developing means, serving as said process means, and an image bearing member, serving as said electrophotographic photosensitive member, are incorporated as one unit being detachably mountable to said image forming apparatus.

19. An image forming apparatus for forming images on recording media, said apparatus being adapted for receiving a process cartridge detachably mounted thereto, said apparatus comprising:

mounting means on which said process cartridge is detachably mounted, said process cartridge having a frame comprising an upper surface, an electrophotographic photosensitive member, process means which acts on said electrophotographic photosensitive member, and an elastic pressing member for suppressing vibration and provided on said upper surface of said frame in such a manner that it is sandwiched between an image forming apparatus body and said upper surface of said frame when said process cartridge is detachably mounted in said image forming apparatus; and conveying means for conveying said recording media.

20. A process cartridge which can be detachably mounted to an image forming apparatus body, said process cartridge comprising:

a frame;

an electrophotographic photosensitive member;

process means which acts on said electrophotographic photosensitive member;

a protective cover comprising an inner surface and provided on said frame in such a manner as to be movable between a protecting position where said cover protects said electrophotographic photosensitive member and a retracted position where said cover retracts from said protecting position; and an elastic pressing member for suppressing vibration and provided on said inner surface of said protective cover in such a manner that it becomes sandwiched between said frame and said inner surface of said protective cover when said protective cover is in said retracted position.

21. An image forming apparatus for forming images on recording media, said apparatus being adapted to receive a process cartridge detachably mounted thereto, said apparatus comprising:

mounting means on which said process cartridge is mounted, said process cartridge having a frame, an electrophotographic photosensitive member, process means which acts on said electrophotographic photosensitive member, and a protective cover comprising an inner surface and provided on said frame in such a manner as to be movable between a protecting position where said cover protects said electrophotographic photosensitive member and a retracted position where said cover retracts from said protecting position, and an elastic pressing member for suppressing vibration and provided on said inner surface of said protective cover in such a manner that it becomes sandwiched between said frame and said inner surface of said protective cover when said protective cover is in said retracted position; and conveying means for conveying said recording media.

22. A process cartridge detachably mountable to a body of an image forming apparatus, said process cartridge comprising:

a frame comprising an upper surface;

an electrophotographic photosensitive drum;

a developing roller for developing a latent image formed on said electrophotographic photosensitive drum;

a charging roller for charging said electrophotographic photosensitive drum;

a cleaning unit for removing a remaining toner on said electrophotographic photosensitive drum; and an elastic member for suppressing vibration and provided on said upper surface of said frame in such a manner that said elastic member is sandwiched between the image forming apparatus body and said upper surface of said frame when said process cartridge is mounted to the image forming apparatus, wherein said elastic member has a Shore A hardness in the range of between approximately 30 degrees and 90 degrees, and said elastic member is in contact with at least 10% of an area of said upper surface.

23. The process cartridge according to claim 22, wherein said elastic member is rubber has a loss tangent of between approximately 0.1 and 1.0.

24. The process cartridge according to claim 22, wherein said elastic member comprises a material selected from the group consisting of butyl rubber, natural rubber, SBR (styrene butadiene copolymer), chlorine type rubber, urethane rubber, silicon rubber, flurorubber, EPDM (tercopolymer of ethylene propylene diene) rubber, and any material which contains and inorganic filler and an oil.

* * * * *